US008395324B2

(12) United States Patent
Bilenko et al.

(10) Patent No.: US 8,395,324 B2
(45) Date of Patent: Mar. 12, 2013

(54) LIGHT EMITTING SYSTEM WITH DUAL USE LIGHT ELEMENT

(75) Inventors: Yuriy Bilenko, Columbia, SC (US); Remigijus Gaska, Columbia, SC (US); Michael Shur, Latham, NY (US); Alexei Koudymov, Troy, NY (US)

(73) Assignee: Sensor Electronic Technology, Inc., Columbia, SC (US)

( * ) Notice: Subject to any disclaimer, the term of this patent is extended or adjusted under 35 U.S.C. 154(b) by 399 days.

(21) Appl. No.: 12/763,674

(22) Filed: Apr. 20, 2010

(65) Prior Publication Data

US 2010/0264835 A1 Oct. 21, 2010

Related U.S. Application Data

(60) Provisional application No. 61/214,125, filed on Apr. 20, 2009.

(51) Int. Cl.
*H05B 37/02* (2006.01)

(52) U.S. Cl. ..... 315/152; 315/155; 315/158; 250/208.2; 250/216

(58) Field of Classification Search ..... 315/149–150, 315/152, 155, 158; 250/216, 208.2, 552
See application file for complete search history.

(56) References Cited

U.S. PATENT DOCUMENTS 4,588,883 A 5/1986 Abbas
5,055,894 A * 10/1991 Chan ..... 257/85
5,130,762 A 7/1992 Kulick
5,424,855 A * 6/1995 Nakamura et al. ..... 358/472
5,856,727 A * 1/1999 Schroeder et al. ..... 315/55
5,917,534 A 6/1999 Rajeswaran
6,031,251 A 2/2000 Gempe et al.
6,617,560 B2 * 9/2003 Forke ..... 250/205
7,329,998 B2 * 2/2008 Jungwirth ..... 315/291
8,058,606 B2 * 11/2011 Young et al. ..... 250/223 R
2010/0253229 A1 * 10/2010 Verschuren ..... 315/152

OTHER PUBLICATIONS

Sensor Electronic Technology, Inc., "Deep UV LED Light Sources", Jan. 2008, 1 page.

Gaska et al., Sensor Electronic Technology, Inc., "Novel Sources for Optical Sensors: III-Nitride Semiconductor-Based Deep Ultraviolet Light Emitting Diodes", PITTCON Conference & Expo, Feb. 2010, 1 page.

Sensor Electronic Technology, Inc., "The only true source of UV LEDs from 240nm through 355nm", Mar. 2010, 2 pages.

* cited by examiner

*Primary Examiner* — Jason M Crawford
(74) *Attorney, Agent, or Firm* — John W. LaBatt

(57) ABSTRACT

A solution is provided in which one or more of a plurality of light elements is alternately operated as a light emitting element and a light detecting element. For example, a system can operate a light element as a light detecting element while operating at least one other light element as a light emitting element in order to manage operation of the light elements to generate light having a set of desired attributes, evaluating an operating condition of the other light element(s), and/or the like.

21 Claims, 6 Drawing Sheets

LIGHT EMITTING SYSTEM WITH DUAL USE LIGHT ELEMENT

REFERENCE TO PRIOR APPLICATIONS

The current application claims the benefit of U.S. Provisional Application No. 61/214,125, titled "Light emitting system with monitoring unit," which was filed on 20 Apr. 2009, and which is hereby incorporated by reference.

TECHNICAL FIELD

The disclosure relates generally to light emitting systems, and more particularly, to a light emitting system including one or more dual use light elements configured to alternate between operating as a light emitting element and operating as a light detecting element.

BACKGROUND ART

Many applications for light emitting systems require such systems to provide high reliability, output optical power stability, spectral content stability, and high control repeatability. In general, instant control of the optical output can be performed by the introduction of additional photodetector elements, which can be attached or integrated with the light emitting elements in a device. The inclusion of dedicated photodetector elements in the device adds complexity to the fabrication, difficulty to the packaging, and increases the cost of the device.

SUMMARY OF THE INVENTION

Aspects of the invention provide a solution in which one or more of a plurality of light elements is alternately operated as a light emitting element and a light detecting element. For example, a system can operate a light element as a light detecting element while operating at least one other light element as a light emitting element in order to manage operation of the light elements to generate light having a set of desired attributes, evaluate an operating condition of the other light element(s), and/or the like. By using the same light element to both emit and detect light, a need to introduce additional active elements can be eliminated, which can result in a cost savings, reduction in size, improved reliability, extended operating life, and/or the like for the corresponding system.

A first aspect of the invention provides a system comprising: a plurality of light elements; and a management system including a set of computing devices, wherein the management system is configured to implement a method of managing the plurality of light elements, the method including: alternately operating at least one of the plurality of light elements as a light emitting element and a light detecting element, wherein the at least one of the plurality of light elements is operated as a light detecting element while operating at least one other of the plurality of light elements as a light emitting element.

A second aspect of the invention provides a computer-implemented method of managing a plurality of light elements, the method comprising: alternately operating at least one of the plurality of light elements as a light emitting element and a light detecting element using a computer system, wherein the at least one of the plurality of light elements is operated as a light detecting element while operating at least one other of the plurality of light elements as a light emitting element.

A third aspect of the invention provides a method of generating a light emitting system, the method comprising: fabricating a light emitting component, the fabricating including forming a plurality of light elements on a substrate; and connecting the light emitting component to a computer system, wherein the computer system is configured to alternately operate at least one of the plurality of light elements as a light emitting element and a light detecting element.

Other aspects of the invention provide methods, systems, program products, and methods of using and generating each, which include and/or implement some or all of the actions described herein. The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide a solution in which one or more of a plurality of light elements is alternately operated as a light emitting element and a light detecting element. For example, a system can operate a light element as a light detecting element while operating at least one other light element as a light emitting element in order to manage operation of the light elements to generate light having a set of desired attributes, evaluate an operating condition of the other light element(s), and/or the like. By using the same light element to both emit and detect light, a need to introduce additional active elements can be eliminated, which can result in a cost savings, reduction in size, improved reliability, extended operating life, and/or the like for the corresponding system.

As used herein, unless otherwise noted, the term "set" means one or more (i.e., at least one) and the phrase "any solution" means any now known or later developed solution. Additionally, as used herein the term "light" means electromagnetic radiation having any wavelength, including wavelengths within the visible light spectrum and/or non-visible wavelengths above and/or below the visible light spectrum (e.g., ultraviolet (UV), infrared, and/or the like).

Figure 1:
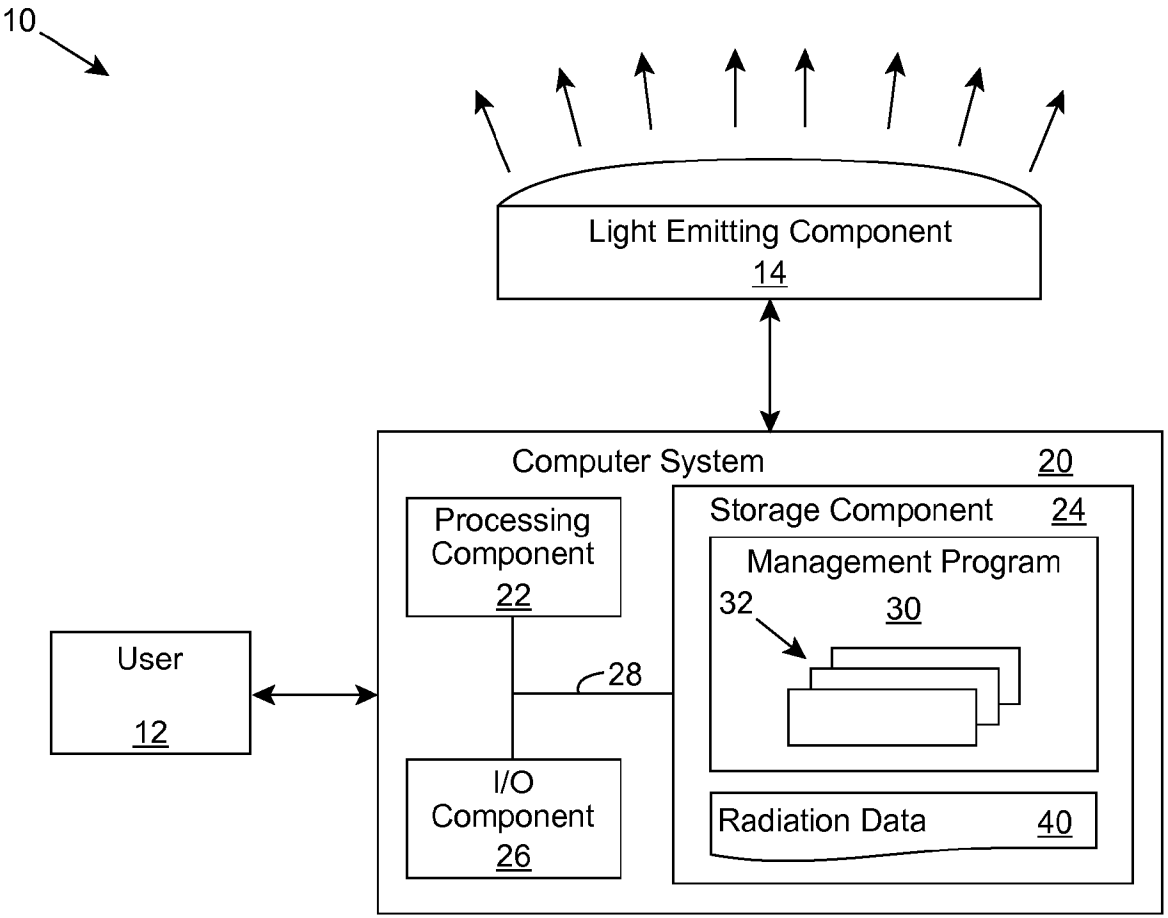
FIG. 1 shows an illustrative light emitting system according to an embodiment.

Turning to the drawings, FIG. 1 shows an illustrative light emitting system 10 according to an embodiment. To this extent, system 10 includes a computer system 20 that can perform a process described herein in order to manage operation of light emitting component 14. In particular, computer system 20 is shown including a management program 30, which makes computer system 20 operable to manage operation of light emitting component 14 by performing a process described herein.

Computer system 20 is shown including a processing component 22 (e.g., one or more processors), a storage component 24 (e.g., a storage hierarchy), an input/output (I/O) component 26 (e.g., one or more I/O interfaces and/or devices), and a communications pathway 28. In general, processing component 22 executes program code, such as management program 30, which is at least partially fixed in storage component 24. While executing program code, processing component 22 can process data, which can result in reading and/or writing transformed data from/to storage component 24 and/or I/O component 26 for further processing. Pathway 28 provides a communications link between each of the components in computer system 20. I/O component 26 can comprise one or more human I/O devices, which enable a human user 12 to interact with computer system 20 and/or one or more communications devices to enable a system user 12 to communicate with computer system 20 using any type of communications link. To this extent, management program 30 can manage a set of interfaces (e.g., graphical user interface(s), application program interface, and/or the like) that enable human and/or system users 12 to interact with management program 30. Furthermore, management program 30 can manage (e.g., store, retrieve, create, manipulate, organize, present, etc.) the data, such as radiation data 40, using any solution.

In any event, computer system 20 can comprise one or more general purpose computing articles of manufacture (e.g., computing devices) capable of executing program code, such as management program 30, installed thereon. As used herein, it is understood that "program code" means any collection of instructions, in any language, code or notation, that cause a computing device having an information processing capability to perform a particular action either directly or after any combination of the following: (a) conversion to another language, code or notation; (b) reproduction in a different material form; and/or (c) decompression. To this extent, management program 30 can be embodied as any combination of system software and/or application software.

Further, management program 30 can be implemented using a set of modules 32. In this case, a module 32 can enable computer system 20 to perform a set of tasks used by management program 30, and can be separately developed and/or implemented apart from other portions of management program 30. As used herein, the term "component" means any configuration of hardware, with or without software, which implements the functionality described in conjunction therewith using any solution, while the term "module" means program code that enables a computer system 20 to implement the actions described in conjunction therewith using any solution. When fixed in a storage component 24 of a computer system 20 that includes a processing component 22, a module is a substantial portion of a component that implements the actions. Regardless, it is understood that two or more components, modules, and/or systems may share some/all of their respective hardware and/or software. Further, it is understood that some of the functionality discussed herein may not be implemented or additional functionality may be included as part of computer system 20.

When computer system 20 comprises multiple computing devices, each computing device can have only a portion of management program 30 fixed thereon (e.g., one or more modules 32). However, it is understood that computer system 20 and management program 30 are only representative of various possible equivalent computer systems that may perform a process described herein. To this extent, in other embodiments, the functionality provided by computer system 20 and management program 30 can be at least partially implemented by one or more computing devices that include any combination of general and/or specific purpose hardware with or without program code. In each embodiment, the hardware and program code, if included, can be created using standard engineering and programming techniques, respectively.

Regardless, when computer system 20 includes multiple computing devices, the computing devices can communicate over any type of communications link. Furthermore, while performing a process described herein, computer system 20 can communicate with one or more other computer systems and/or components, such as light emitting component 14, using any type of communications link. In either case, the communications link can comprise any combination of various types of wired and/or wireless links; comprise any combination of one or more types of networks; and/or utilize any combination of various types of transmission techniques and protocols.

Figure 2:
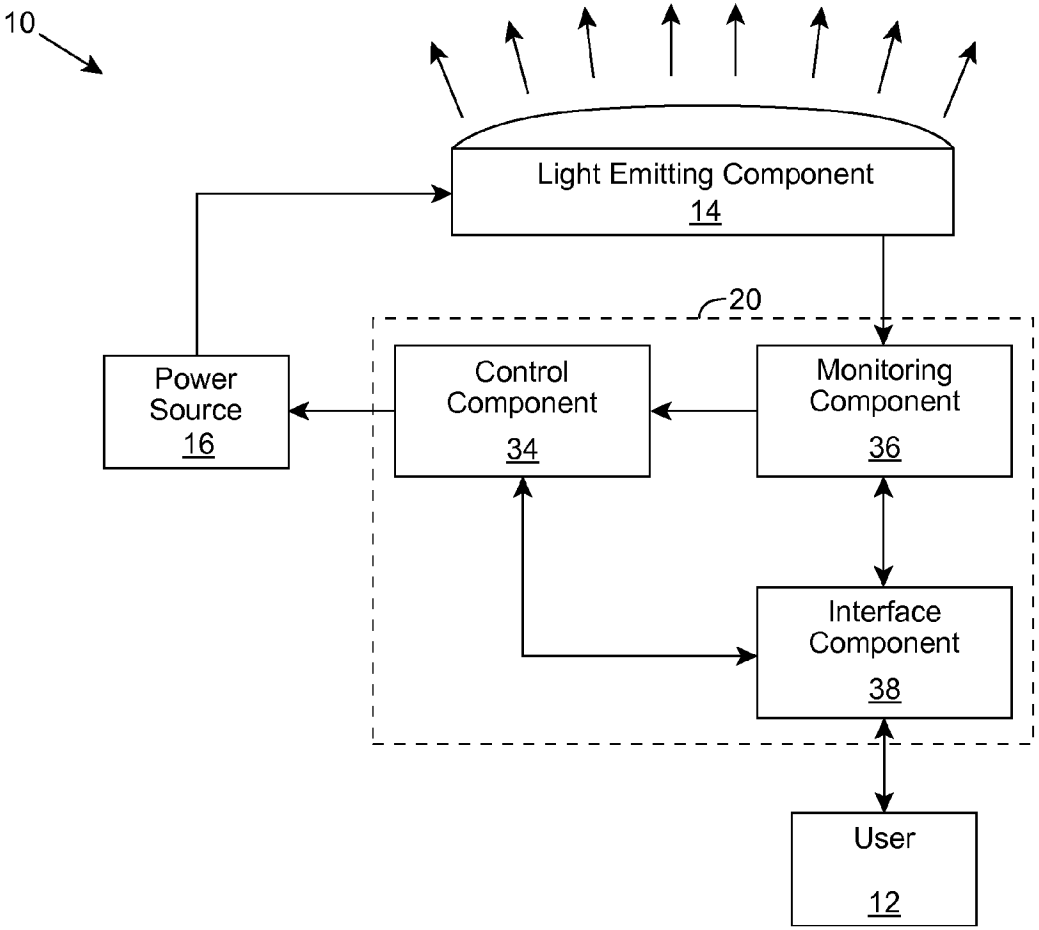
FIG. 2 shows an illustrative flow diagram of a light emitting system according to an embodiment.

As discussed herein, management program 30 enables computer system 20 to manage operation of light emitting component 14. To this extent, FIG. 2 shows an illustrative flow diagram of a light emitting system 10 according to an embodiment. As illustrated, computer system 20 can comprise a control component 34, a monitoring component 36, and an interface component 38. Each component shown within computer system 20 can be implemented, for example, as a module 32 (FIG. 1) of management program 30 (FIG. 1).

In any event, control component 34 can operate the power source 16 to provide power to light emitting component 14. Light emitting component 14 can consume the power and produce light as an output. In an embodiment, light emitting component 14 comprises a plurality of light elements. As used herein, "light element" refers to any light emitting element or light detecting element. A light emitting element is a component, such as a light emitting diode (LED), that produces light when power (e.g., electrical and/or optical) is provided to the component. A light detecting element is a component, such as a photodetector, whose operation is altered in response to one or more properties of incident light. In operation, power source 16 can provide electrical and/or optical power to each of the light elements in light emitting component 14, and light emitting component 14 can consume the power and produce light having a corresponding optical power.

Additionally, power source 16 can provide electrical and/or optical power to one or more light detecting elements within light emitting component 14. Light being produced by the light emitting elements within light emitting component 14 can strike the light detecting element(s) within light emitting component 14, which can generate a signal based on one or more aspects of the light in response. As described herein, light emitting component 14 can include one or more light elements that, based on the power provided to the light element by power source 16, can be operated as either a light emitting element or a light detecting element.

Computer system 20 can further include a monitoring component 36, which receives the signal generated by each light detecting element in light emitting component 14, stores the signal as radiation data 40 (FIG. 1), and monitors at least one aspect of the light detected by the light detecting element(s) based on the signal(s) received and radiation data 40. For example, monitoring component 36 can process the signal(s) in order to monitor one or more of: radiation intensity, spectral output content, optical power, and/or the like. Computer system 20 can manage operation of power source 16 and the corresponding light elements within light emitting component 14 based on the monitored aspect(s) and radiation data 40, such as historical light data, desired aspect(s) for the light, and/or the like.

In an embodiment, control component 34 and monitoring component 36 can implement a feedback loop, which provides instant control, stabilization, and/or other self-adjusting functions with respect to one or more aspects of the generated light, such as the radiation intensity, spectral output content, optical power, and/or the like. To this extent, monitoring component 36 can determine in real time whether a monitored aspect is within an acceptable range of a desired value. When an aspect of the light is outside of the acceptable range, monitoring component 36 can signal control component 34 to make one or more adjustments to the operation of one or more of the light emitting elements within light emitting component 14.

Control component 34 can adjust one or more aspects of the power being provided by power source 16 to the corresponding light emitting element(s) in order to adjust the operation of the light emitting element(s) and the corresponding light being generated. For example, monitoring component 36 can signal that an aspect is below or above an acceptable range. In response to the signal, control component 34 can adjust (e.g., increase or decrease) an electrical voltage, a pulsing rate, an optical power, polarization, direction of a beam, a spectral content, and/or the like, of the power being provided to the light emitting element(s). In more particular examples, control component 34 can: adjust one or more aspects (e.g., number, rate, duration, time interval, and/or the like) of pulse modulation of a voltage bias to correct the radiation intensity of the generated light; turn on or off one or more diodes to adjust the spectral content output of the generated light; adjust bias, pulse width modulation, and/or the like to adjust the optical power of the generated light; etc.

In an embodiment, monitoring component 36 can evaluate an operating condition of light emitting element(s) in light emitting component 14 based on the monitored at least one aspect of the light detected by the light detecting element(s). For example, monitoring component 36 can predict a time period that one or more light emitting elements will continue to operate effectively. To this extent, as a light emitting element begins to approach the end of its operating life, one or more aspects of the light generated by the light emitting element can change. Monitoring component 36 can use radiation data 40 to detect the change(s) in the signals received from light emitting component 14 over a period of time and predict the time period for its remaining operating life by projecting the detected changes over time into the future, curve fitting the detected changes with a curve for the typical lifetime behavior for the light emitting element, and/or the like. Similarly, monitoring component 36 can predict an upcoming failure of a light emitting element, e.g., due to a change in one or more of the aspects of the light generated by the light emitting element. For example, over the operating life of a light element, an intensity of the emitted light can gradually decrease in a predictable manner. A drop of intensity below a threshold value can indicate a failure of the light element.

In any event, computer system 20 also can include an interface component 38, which can enable a user 12 to manage one or more aspects of the operation of computer system 20 and light emitting component 14. To this extent, interface component 38 can manage a set of human user interfaces (e.g., graphical user interfaces) and/or application program interfaces, which enable the user 12 to control, monitor, and/or the like, one or more aspects of the operation of light emitting system 10. For example, interface component 38 can enable the user 12 to adjust one or more aspects of the light generated by light emitting component 14, monitor one or more aspects of the light generated by light emitting component 14, receive and/or respond to alert messages, such as a failure/pending failure of a light emitting element in light emitting component 14, evaluate a remaining operating life for light emitting component 14, and/or the like. In an embodiment, user 12 can define a set of desired aspects of the light, e.g., desired spectral distribution, time/event-triggered changes to the aspect(s), and/or the like, using interface component 38, which can subsequently be automatically implemented by computer system 20 during operation of the light emitting component 14.

As discussed herein, light emitting component 14 includes one or more light emitting elements and one or more light detecting elements. In an embodiment, at least one light element in light emitting component 14 comprises a light element having a dual mode of operation. The light element can be fabricated using any solution. For example, the light element can comprise a light emitting diode (LED), which can be operated as a photodetector by applying a reverse voltage bias or no voltage bias. A light element can emit and/or detect light having any range of wavelengths, within or outside of the visible spectrum. In an embodiment, one or more light elements operate in the ultraviolet range.

In an embodiment, light emitting component 14 comprises a deep ultraviolet light source. In this case, light emitting component 14 can comprise a plurality of light elements, each of which comprises a deep ultraviolet LED. Light emitting component 14 can comprise an LED configured to emit light of multiple wavelengths and/or multiple LEDs configured to emit light of different wavelengths. For example, light emitting component 14 can comprise one or more LEDs configured to emit light having a wavelength of approximately 255 nanometers (+/−5 nanometers) and one or more LEDs configured to emit light having a wavelength of approximately 295 nanometers (+/−5 nanometers). In another embodiment, light emitting component 14 comprises eight or more LEDs configured to emit/detect light having various wavelengths between approximately 240 nanometers and approximately 850 nanometers.

In an embodiment, an illustrative light element comprises a deep ultraviolet LED manufactured using the group III-Nitride based material system. In a more particular embodiment, the illustrative light element comprises a layer structure design as shown and described in U.S. Pat. No. 7,619,238, which is hereby incorporated by reference.

An illustrative LED can include four contacts, two of which are used to operate the LED as a light emitting element, and two of which are used to operate the LED as a light detecting element. Similarly, another illustrative LED can include eight contacts, four of which are used to operate the LED as a light emitting/detecting element for a first wavelength (e.g., 255 nanometers), and the other four of which are used to operate the LED as a light emitting/detecting element for a second wavelength (e.g., 295 nanometers). It is understood that an LED can include additional contacts, such as for temperature and/or power control, and/or the like.

Figure 3:
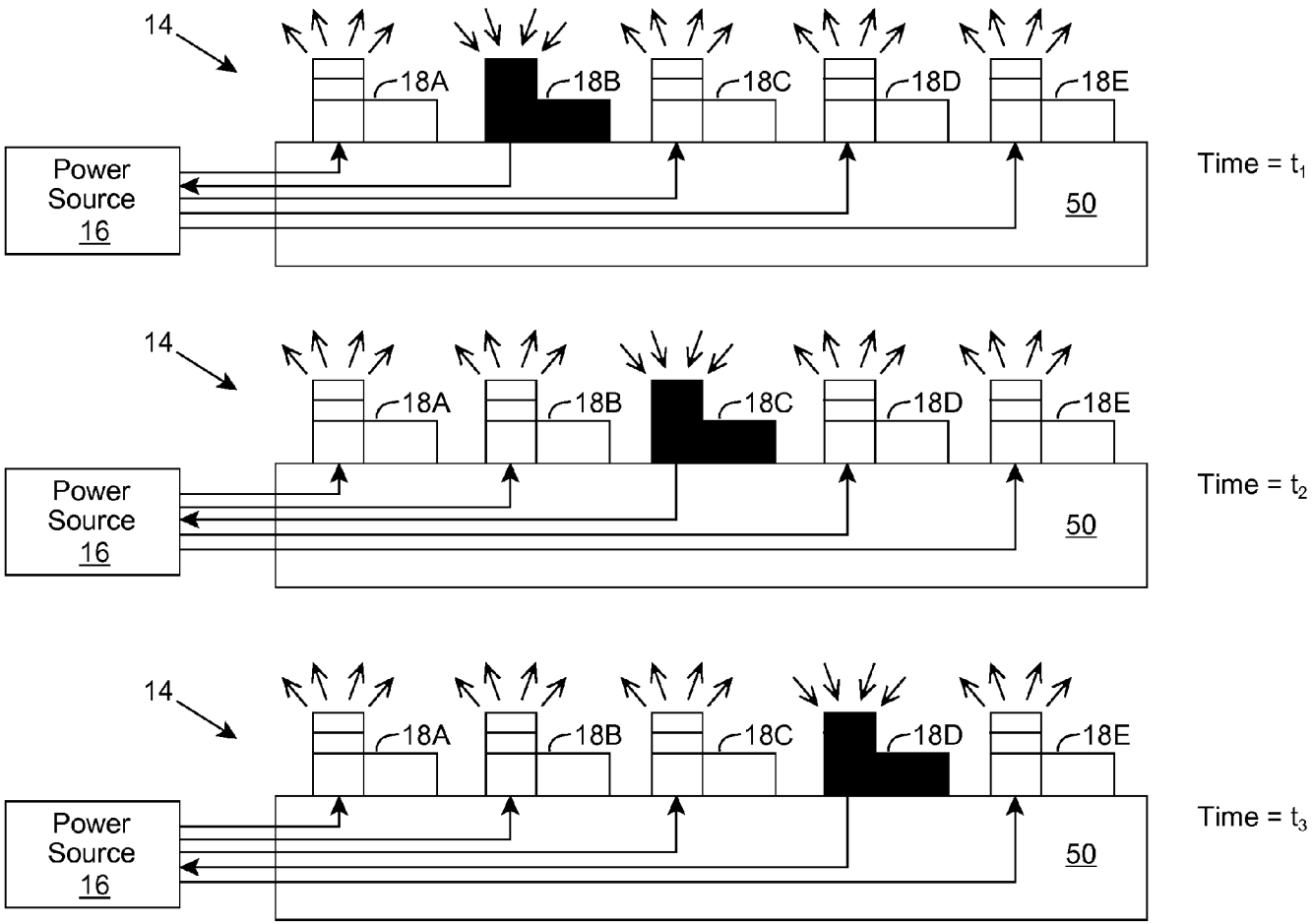
FIG. 3 shows an illustrative method of operating of an illustrative light emitting component according to an embodiment.

Control component 34 can alternately operate the light element as a light emitting element (e.g., a light emitting diode) and a light detecting element (e.g., a photodetector). To this extent, FIG. 3 shows an illustrative method of operating of an illustrative light emitting component 14 according to an embodiment. As illustrated, power source 16 can separately provide power to each of a plurality of light elements 18A-18E of light emitting component 14. It is understood that while five light elements 18A-18E are shown and described herein, light emitting component 14 can comprise any number of two or more light elements. Additionally, while light elements 18A-18E are shown located in a row, it is understood that the light elements of light emitting component 14 can be arranged in any shape/pattern.

In any event, computer system 20 (FIG. 1) can alternately operate a light element 18A-18E as a light emitting element and a light detecting element during operation of light emitting component 14. In this case, a light element used to emit light also can be used in monitoring/control management functions, thereby eliminating a need to introduce additional active elements, which can result in a cost savings, reduction in size, improved reliability, extended operating life, and/or the like for the corresponding system.

In an embodiment, operation of a light element 18A-18E is switched between a light emitting element and a light detecting element by altering the power provided to the light element 18A-18E by power source 16. For example, power source 16 can apply a reverse voltage bias (e.g., more than the thermal voltage for the element) or zero/no bias to operate a light element 18A-18E as a light detecting element, and apply a forward voltage bias (e.g., exceeding the on voltage) to operate the light element 18A-18E as a light emitting element. To this extent, computer system 20 can direct power source 16 to provide a corresponding voltage bias to each light element 18A-18E based on a desired configuration of light detecting/emitting elements at a given time during the operation of light emitting component 14.

For example, at a first operating time, $t_1$, computer system 20 (FIG. 1) can operate the light element 18B as a light detecting element, while operating the remaining light elements 18A, 18C-18E as light emitting elements. At different times, $t_2$ and $t_3$, computer system 20 can operate light element 18B as a light emitting element. Similarly, computer system 20 can operate the light element 18C as a light detecting element at time $t_2$, and operate the light element 18D as a light detecting element at time $t_3$. While not shown, it is understood that computer system 20 also can operate light elements 18A, 18E as light detecting elements during the operation of light emitting component 14.

In an embodiment, computer system 20 operates only one of the light elements 18A-18E as a light detecting element while operating each of the other light elements 18A-18E as a light emitting element. For example, computer system 20 can operate each light element 18A-18E as a light detecting element for a given time period before alternating to a different light element 18A-18E to operate as a light detecting element. Computer system 20 can implement a repeating pattern during operation of light emitting component 14 during which each of the light elements 18A-18E is periodically operated as a light detecting element. However, it is understood that computer system 20 can concurrently operate two or more of the light elements 18A-18E as a light detecting element in other embodiments. Additionally, it is understood that computer system 20 can operate all of the light elements 18A-18E as light emitting elements at a given time, and periodically alternate one or more of the light elements 18A-18E to operate as a light detecting element.

Figure 4:
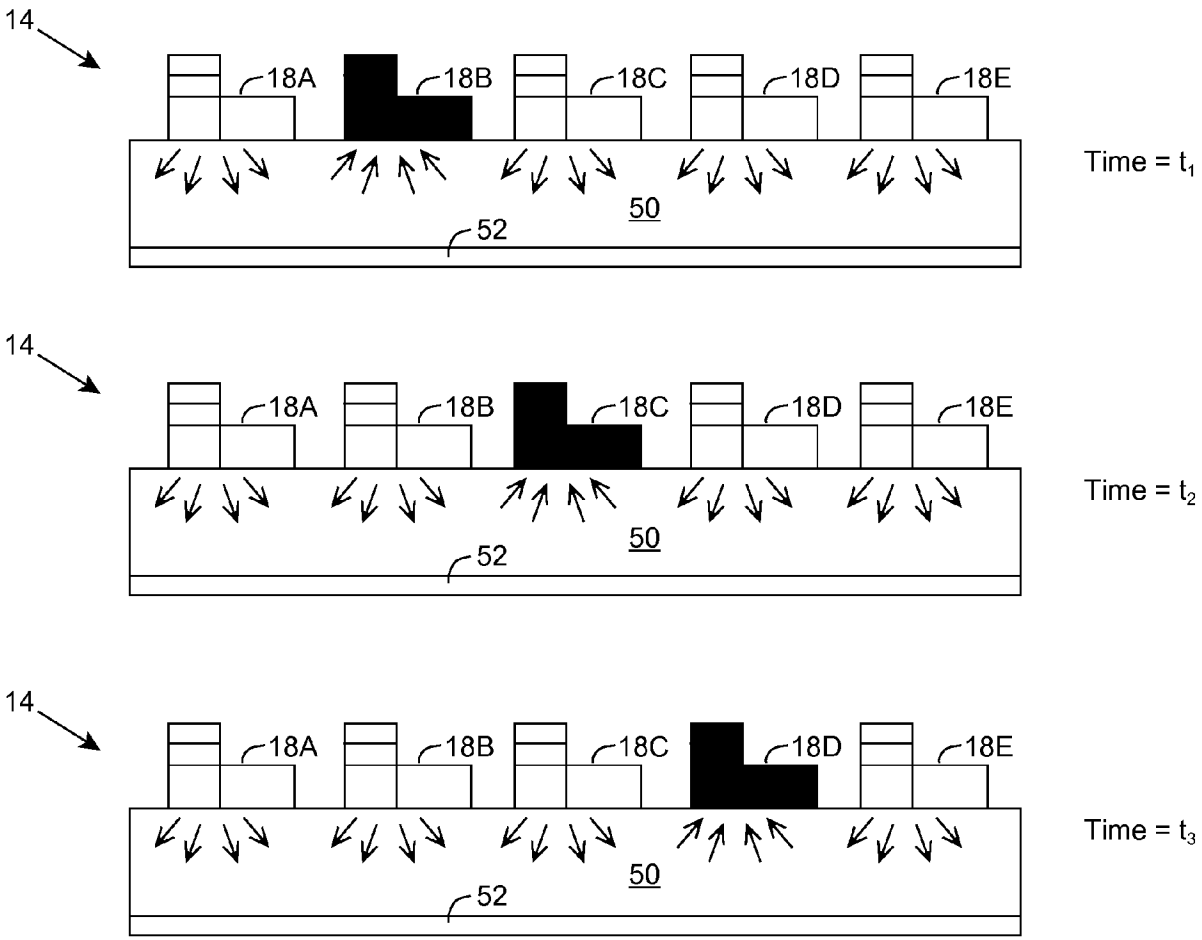
FIG. 4 shows an illustrative method of operating of another illustrative light emitting component according to an embodiment.

As illustrated, each light element 18A-18E is configured to generate light that shines away from the substrate 50 towards open space when operated as a light emitting element. For example, a light element 18A-18E can comprise a flip-chip design with an optically active surface facing away from substrate 50 towards open space. FIG. 4 shows the illustrative method of FIG. 3 for operating another illustrative light emitting component 14 according to an embodiment. In this case, light elements 18A-18E are configured to generate light that shines towards the substrate 50 when operated as a light emitting element. Substrate 50 can comprise a transparent substrate for the corresponding wavelengths of generated light, which enables optical coupling through the substrate 50. Light emitting component 14 also can include a reflective layer 52, such as a metal layer, on an opposing side of the substrate 50 from the light elements 18A-18E to reflect the generated light back into the substrate 50, thereby increasing the optical coupling between the light elements 18A-18E.

Optical coupling between some or all of the light elements 18A-18E can be implemented/enhanced using any solution. For example, optical coupling can be provided by an active region waveguide. Additionally, one or more light elements 18A-18E can comprise a design that provides a full reflection angle for improved optical connection with adjacent light element(s) 18A-18E.

Figure 5:
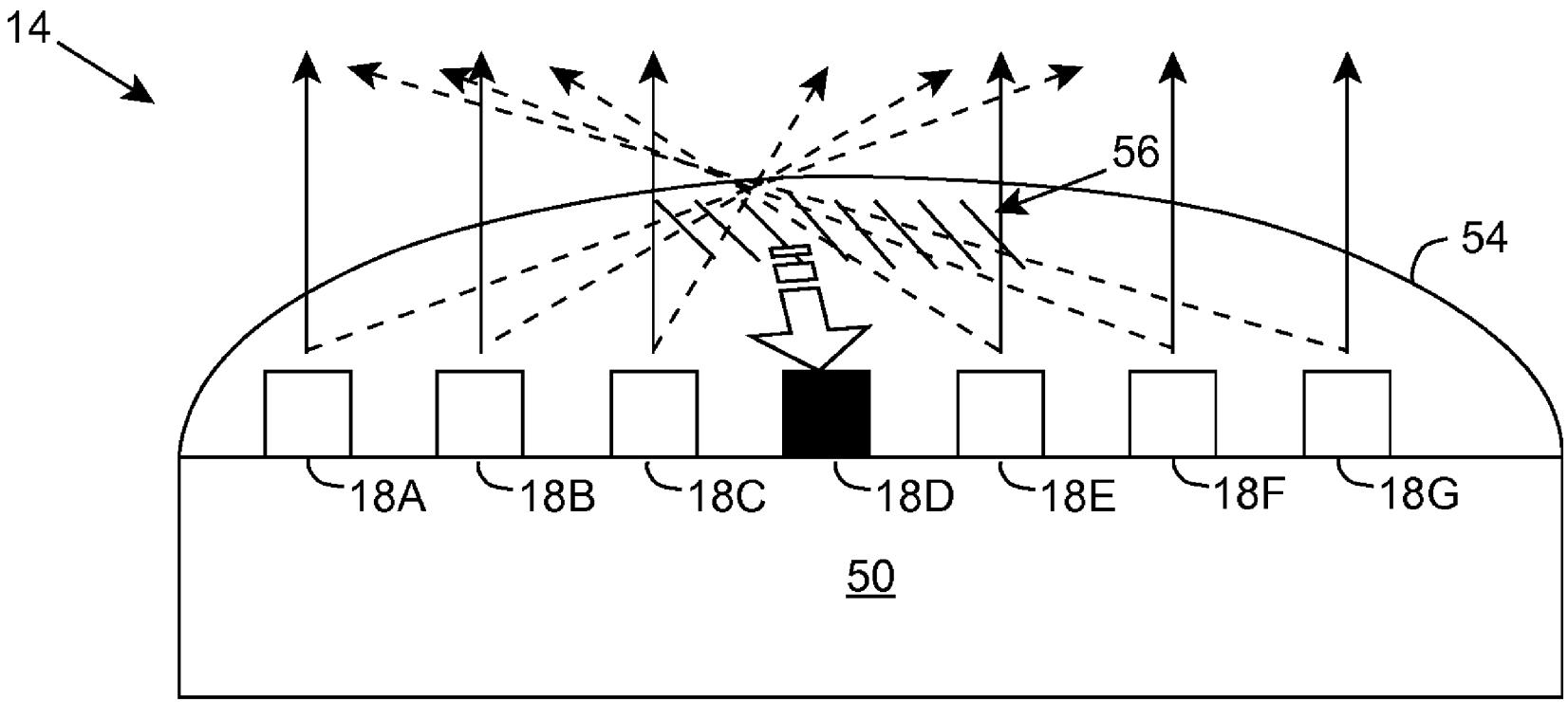
FIG. 5 shows an illustrative light emitting component according to an embodiment.

An embodiment also enhances optical coupling between light elements 18A-18E configured to generate light that shines away from the substrate 50. For example, FIG. 5 shows an illustrative light emitting component 14 according to an embodiment. As illustrated, light elements 18A-18G are configured to generate light shining away from the substrate 50. Light emitting component 14 includes an encapsulation layer 54, which can be configured to provide protection for light elements 18A-18G and mix the light generated by the various light elements 18A-18G. Additionally, a surface of the encapsulation layer 54 includes a diffraction grating 56, which can enhance an amount of light that reflects back towards the light elements 18A-18G, and particularly a light element, such as light element 18D, being operated as a light detecting element. Diffraction grating 56 can be formed on the internal and/or external surface of encapsulation layer 54 using any solution, such as a scratch system, an additional metallization structure, polishing, and/or the like. While diffraction grating 56 is shown having a particular location and pattern, it is understood that this is only illustrative, and any location/pattern can be used to enhance the optical coupling.

Additionally, substrate 50 can be processed to improve the optical coupling between light elements 18A-18G. For example, a reflective layer can be included on the same side of substrate 50 as the light elements 18A-18G. Similarly, a diffraction grating can be formed on the surface of the substrate 50 with the light elements 18A-18G, e.g., by applying an additional metallization structure, using a scratch system, polishing, and/or the like.

Figure 6:
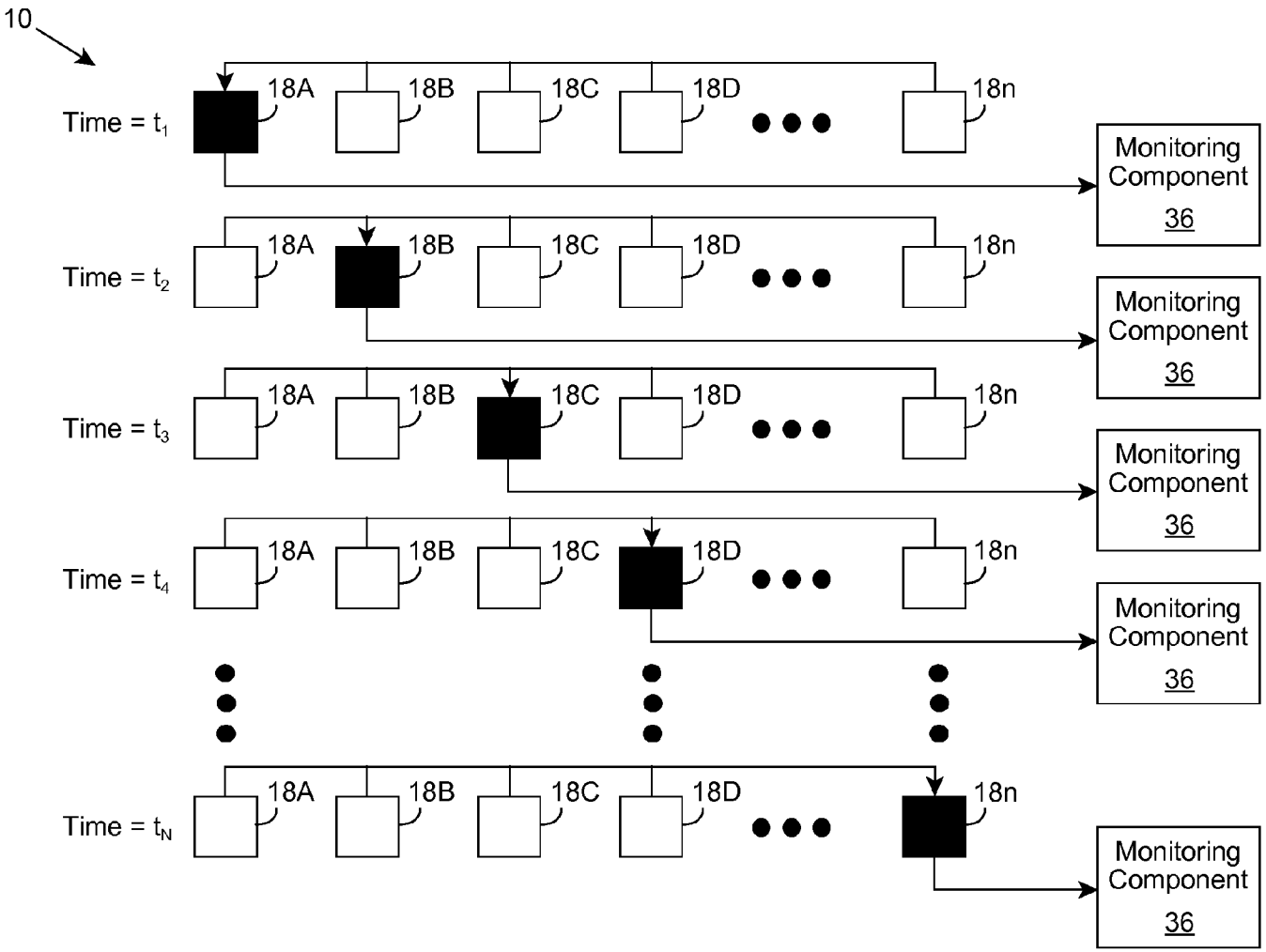
FIG. 6 shows an illustrative signal exchange block diagram of a light emitting component according to an embodiment.

FIG. 6 shows an illustrative signal exchange block diagram of a portion of the light emitting system 10 (FIG. 2) according to an embodiment. In this case, the light emitting component 14 (FIG. 2) includes any number of light elements 18A-18*n*, each of which can be operated in dual mode as either a light emitting element or a light detecting element. At each unique time period, $t_1$-$t_N$, one of the light elements 18A-18*n* is operated as a light detecting element, while the remaining light elements 18A-18*n* are operated as light emitting elements. The light element operating as a light detecting element changes on transition from one time to the next until all of the light elements have operated as a light detecting element.

After N time periods, the pattern can repeat while the light emitting component 14 continues to be operated.

As illustrated at time $t_1$, for example, the various light elements 18B-18*n* being operated as light emitting elements generate light that acts as an input signal to the light element 18A being operated as a light detecting element. The light element 18A being operated as a light detecting element generates a corresponding signal that comprises an input signal to monitoring component 36. Monitoring component 36 can receive the signal from the corresponding light element 18A-18*n* operated as a light detecting element using any solution. For example, control component 34 (FIG. 2) can operate a switch for each light element 18A-18*n* to selectively complete/break a signal path (e.g., electrical) between the light element 18A-18*n* and the monitoring component 36. In this case, control component 34 can operate the switch corresponding to the light element operating as a light detecting element to complete the signal path, and operate every other switch to break the signal path. Alternatively, monitoring component 36 can comprise a unique signal path for each of the light elements 18A-18*n*, and process only the signal received that corresponds to the light element 18A-18*n* currently being operated as a light detecting element.

By operating the various light elements 18A-18*n* as light detecting elements, the location(s) from which the light is detected will vary. As a result, computer system 20 (FIG. 1) can use the different locations to extract information about one or more of the light elements 18A-18*n*. For example, depending on the optical coupling, light generated by the light elements 18A-18*n* that are closer to a light element being operated as a light detecting element can have a more significant impact on the detected light. Computer system 20 can use this information to identify a particular problem light element 18A-18*n*. Similarly, changes to the overall light emitted by light emitting component 14 can be at least partially attributed to the light element that is not being operated as a light emitting element. Still further, a significant difference between the light detected by one light element versus the other light elements 18A-18*n* can indicate a problem with operation of the one light element.

While the various light elements 18A-18*n* have been described herein as being alternately operated as light detecting elements to obtain feedback on the light being generated by the other light elements 18A-18*n*, it is understood that the various light elements 18A-18*n* can be configured and operated to detect light from an external source. For example, a light element 18A-18*n* can be operated to detect ambient light for an area to determine whether and what amount of light generated from light elements 18A-18*n* is required, one or more desirable attributes of the light (e.g., to enhance contrast between colors present in the area, or the like), and/or the like. To this extent, computer system 20 (FIG. 1) could concurrently operate all or multiple light elements 18A-18*n* as light detecting elements. In an embodiment, light emitting component 14 can comprise a plurality of pairs of light elements 18A-18*n*. Half of the light elements 18A-18*n* can be operated as light emitting elements while the other half are operated as light detecting elements. After an extended period of time (e.g., once failure of one or more light elements 18A-18*n* is near), computer system 20 can switch the light elements 18A-18*n* that are operating as light emitting and light detecting elements. In this manner, a total operating life of light emitting component 14 can be doubled.

While primarily shown and described herein as a method and system for generating and monitoring light using a plurality of light elements, it is understood that aspects of the invention further provide various alternative embodiments. For example, in one embodiment, the invention provides a method of generating a system for generating and monitoring light using a plurality of light elements. In particular, the generating can include fabricating a light emitting component 14 for the light emitting system 10 (FIG. 1). In this case, a substrate 50 can be obtained, and the multiple light elements 18A-18G can be formed on the substrate 50 using any solution. In an embodiment, each light element 18A-18G comprises an identical design for a layer structure. In this case, the light elements 18A-18G can be formed in a single fabrication cycle. For example, each layer of the layer structure can be formed on/applied to substrate 50, and additional processing, such as etching, can be performed to form the various light elements 18A-18G. In a more specific example, an illustrative light element is formed as shown and described in U.S. Pat. No. 7,619,238, which was previously incorporated by reference.

The generating also can include obtaining (e.g., creating, maintaining, accessing, etc.) a computer system, such as computer system 20 (FIG. 1), and obtaining (e.g., creating, purchasing, using, modifying, etc.) and configuring the computer system to perform a process described herein, e.g., by deploying one or more components for performing the process to the computer system. To this extent, the deployment can comprise one or more of: (1) installing program code on a computing device; (2) adding one or more computing and/or I/O devices to the computer system; (3) incorporating and/or modifying the computer system to enable it to perform a process described herein; and/or the like. In an embodiment, the configuring includes: connecting a light emitting component 14 (FIG. 1) to a power source 16 (FIG. 1) and a computer system 20; and configuring the computer system 20 to implement a method described herein.

In another embodiment, the invention provides a computer program fixed in at least one computer-readable medium, which when executed, enables a computer system to generate and monitor light using a plurality of light elements. To this extent, the computer-readable medium includes program code, such as management program 30 (FIG. 1), which implements some or all of a process described herein. It is understood that the term "computer-readable medium" comprises one or more of any type of tangible medium of expression, now known or later developed, from which a copy of the program code can be perceived, reproduced, or otherwise communicated by a computing device. For example, the computer-readable medium can comprise: one or more portable storage articles of manufacture; one or more memory/storage components of a computing device; paper; and/or the like.

In another embodiment, the invention provides a method of providing a copy of program code, such as management program 30 (FIG. 1), which implements some or all of a process described herein. In this case, a computer system can process a copy of program code that implements some or all of a process described herein to generate and transmit, for reception at a second, distinct location, a set of data signals that has one or more of its characteristics set and/or changed in such a manner as to encode a copy of the program code in the set of data signals. Similarly, an embodiment of the invention provides a method of acquiring a copy of program code that implements some or all of a process described herein, which includes a computer system receiving the set of data signals described herein, and translating the set of data signals into a copy of the computer program fixed in at least one computer-readable medium. In either case, the set of data signals can be transmitted/received using any type of communications link.

Returning to FIG. 1, the light emitting system 10 can be configured as part of a system functioning within various different types of applications. For example, system 10 can be implemented as part of an LED-based display device, in which light emitting component 14 comprises an LED display. In this case, one or more of the LEDs can operated in dual mode providing instant feedback on one or more aspects of the display operation.

In another type of application, system 10 can be implemented as part of a lighting system, such as a solid state lighting system, in which light emitting component 14 generates light for a particular illumination purpose. In this case, one or more of the light elements of light emitting component 14 can provide instant feedback on various aspects of the generated light. More particular lighting applications can include LED-based headlights for vehicles, airline illumination systems, surgical lights, lighting systems for humans with visual defects, and/or the like.

In another type of application, system 10 can be implemented as part of a biological system. For example, light from light emitting component 14 can be used to purify water, kill bacteria and/or viruses, monitor and/or detect biological activity, and/or the like. In this application, the feedback from the light sensed by one or more of the light elements can be used to identify the presence, quantity, type, and/or the like, of biological activity that is present, determine an effectiveness with which system 10 has purified and/or killed any undesired organisms, monitor and/or adjust the light being generated to have a desired radiation intensity, spectral output content, optical power, and/or the like, etc.

Other types of applications for system 10 include: a laser pumping system, in which feedback can be used to maintain one or more attributes of the pumping light; an LED communication system, in which feedback can be used to receive light-based communication from another light emitting system; a manufacturing and/or curing system, in which feedback can be used to determine when a process is complete; a spectrometer or fluorometer, in which feedback can be used to measure the wavelengths of reflected light; and/or the like.

For example, a light emitting component 14 can include one or more LEDs emitting light having a first wavelength (e.g., 245 nanometers) onto an object, and one or more LEDs operating as detectors for various wavelengths (e.g., 250, 270, etc.). Based on the detected light, a fluorescence of the object can be analyzed. Similarly, by including light elements that react to various different wavelengths, light emitting component 14 can provide sufficient data to act as a spectrometer. For example, light emitting component 14 can include light elements that react to light having wavelengths of 250 and 280 nanometers and shorter. In this case, light having a wavelength of 240 nanometers will cause both to react, while light having a wavelength of 260 nanometers will only cause one to react. By including sufficient numbers of light elements with differing wavelength sensitivity, computer system 20 can accurately determine a profile of the sensed light.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A system comprising:

a substrate;

a plurality of light elements located on the substrate;

means for enhancing optical coupling between at least one of the plurality of light elements alternately operated as a light emitting element and a light detecting element and at least one other light element in the plurality of light elements; and a management system including a set of computing devices, wherein the management system is configured to implement a method of managing the plurality of light elements, the method including:

alternately operating the at least one of the plurality of light elements as a light emitting element and a light detecting element, wherein the at least one of the plurality of light elements is operated as a light detecting element while operating the at least one other of the plurality of light elements as a light emitting element.

2. The system of claim 1, wherein the alternately operating includes alternately operating each of the plurality of light elements as a light emitting element and a light detecting element.

3. The system of claim 2, wherein each of the plurality of light elements comprises an identical design for a layer structure.

4. The system of claim 1, wherein the method further includes:

monitoring at least one aspect of light detected by a light element operated as a light detecting element; and managing operation of the plurality of light elements based on the at least one aspect of the light.

5. The system of claim 4, wherein the managing operation includes evaluating an operating condition of a light element operated as a light emitting element based on the monitored at least one aspect of the detected light.

6. The system of claim 1, wherein each of the plurality of light elements is configured to generate light shining away from the substrate, and wherein the means for enhancing comprises an encapsulation layer covering the plurality of light elements, wherein a surface of the encapsulation layer includes a diffraction grating.

7. The system of claim 1, wherein the means for enhancing includes at least one of the group consisting of: a transparent substrate, a reflective layer adjacent to the substrate, an active region waveguide, and a full reflection angle for at least one of the plurality of light elements.

8. A computer-implemented method comprising:

obtaining a device including a plurality of light elements and means for enhancing optical coupling between at least one of the plurality of light elements alternately operated as a light emitting element and a light detecting element and at least one other light element in the plurality of light elements; and alternately operating the at least one of the plurality of light elements as a light emitting element and a light detecting element using a computer system, wherein the at least one of the plurality of light elements is operated as a light detecting element while operating the at least one other of the plurality of light elements as a light emitting element.

9. The method of claim 8, wherein the alternately operating includes alternately operating each of the plurality of light elements as a light emitting element and a light detecting element.

10. The method of claim 8, wherein the alternately operating includes operating only one of the plurality of light elements as a light detecting element while operating each of the other plurality of light elements as a light emitting element.

11. The method of claim 8, wherein the method further includes:

monitoring at least one aspect of light detected by a light element operated as a light detecting element; and managing operation of the plurality of light elements based on the at least one aspect of the light.

12. The method of claim 8, wherein the means for enhancing includes a diffraction grating formed on a surface of an encapsulation layer covering the plurality of light elements.

13. The method of claim 8, wherein the means for enhancing includes a reflective layer located on a surface of the substrate.

14. A method of generating a light emitting system, the method comprising:

fabricating a light emitting component, the fabricating including forming a plurality of light elements on a substrate and incorporating means for enhancing optical coupling between at least one of the plurality of light elements alternately operated as a light emitting element and a light detecting element and at least one other light element in the plurality of light elements in the light emitting component; and connecting the light emitting component to a computer system, wherein the computer system is configured to alternately operate the at least one of the plurality of light elements as a light emitting element and a light detecting element.

15. The method of claim 14, wherein each of the plurality of light elements comprises an identical design for a layer structure, and wherein the fabricating includes forming the plurality of light elements on the substrate in a single fabrication cycle.

16. The method of claim 14, further comprising configuring the computer system to implement a method of managing the plurality of light elements, the method of managing the plurality of light elements including the alternately operating.

17. The method of claim 16, the method of managing the plurality of light elements further including:

monitoring at least one aspect of light detected by a light element operated as a light detecting element; and adjusting at least one aspect of the operation of a light element operated as a light emitting element based on the monitored at least one aspect of the detected light.

18. The method of claim 16, the method of managing the plurality of light elements further including:

monitoring at least one aspect of light detected by a light element operated as a light detecting element; and evaluating an operating condition of a light element operated as a light emitting element based on the monitored at least one aspect of the detected light.

19. The method of claim 14, wherein each of the plurality of light elements is configured to generate light shining away from the substrate, the incorporating including forming a diffraction grating on a surface of an encapsulation layer covering the plurality of light elements.

20. The method of claim 14, the incorporating including adding a reflective layer to a surface of the substrate.

21. The method of claim 14, wherein the plurality of light elements are formed in a single fabrication cycle and the incorporating includes incorporating an active region waveguide in the plurality of light elements.

* * * * *